US012264449B2

(12) United States Patent
Miller et al.

(10) Patent No.: US 12,264,449 B2
(45) Date of Patent: Apr. 1, 2025

(54) COUPLER

(71) Applicant: Miller UK Limited, Cramlington (GB)

(72) Inventors: Keith Miller, Cramlington (GB); Gary Miller, Cramlington (GB); Gavin Urwin, Cramlington (GB); Chris Bradley, Cramlington (GB)

(73) Assignee: Miller UK Limited, Northumberland (GB)

( * ) Notice: Subject to any disclaimer, the term of this patent is extended or adjusted under 35 U.S.C. 154(b) by 745 days.

(21) Appl. No.: 17/254,407

(22) PCT Filed: Jun. 21, 2019

(86) PCT No.: PCT/GB2019/051746
§ 371 (c)(1),
(2) Date: Dec. 21, 2020

(87) PCT Pub. No.: WO2020/002882
PCT Pub. Date: Jan. 2, 2020

(65) Prior Publication Data

US 2021/0131057 A1 May 6, 2021

(30) Foreign Application Priority Data

Jun. 25, 2018 (GB) ..... 1810408

(51) Int. Cl.
*E02F 3/36* (2006.01)

(52) U.S. Cl.
CPC ..... *E02F 3/3663* (2013.01); *E02F 3/3618* (2013.01); *E02F 3/3622* (2013.01); *E02F 3/3627* (2013.01); *E02F 3/365* (2013.01)

(58) Field of Classification Search
CPC ..... E02F 3/3663; E02F 3/3618; E02F 3/3622; E02F 3/3627; E02F 3/365
(Continued)

(56) References Cited

U.S. PATENT DOCUMENTS 8,869,437 B2 * 10/2014 Robl ..... E02F 3/3663 37/468
8,974,137 B2 * 3/2015 Parker ..... E02F 3/3672 37/468
(Continued)

FOREIGN PATENT DOCUMENTS

CN 104234099 A 12/2014
DE 202013004797 U1 8/2014
(Continued)

OTHER PUBLICATIONS

International Report on Patentability and Written Opinion for PCT/GB2019/051746 dated Jan. 7, 2021.
(Continued)

*Primary Examiner* — Jamie L McGowan
*Assistant Examiner* — Audrey L Lusk
(74) *Attorney, Agent, or Firm* — Harness, Dickey & Pierce, P.L.C.

(57) ABSTRACT

A coupler including a housing with a top part for attachment to an excavator arm of an excavator, and a bottom part for attachment to an accessory for the excavator, such as an excavator bucket, the bottom part including a front jaw open to a front of the coupler for receiving a first attachment pin of an accessory and a rear pin receiving area for receiving a second attachment pin of the accessory, a latching member for the rear pin receiving area, the latching member including a body, a further jaw extending below the body, a release member extending forward of the body, an attachment point for an end of an actuator and a hole through the body into which a sprung member is located, wherein the sprung member extends through and to under the body and into or partially across a mouth of the further jaw.

18 Claims, 11 Drawing Sheets

(58) Field of Classification Search
USPC ..... 37/468; 172/272
See application file for complete search history.

(56) References Cited

U.S. PATENT DOCUMENTS

| | | | | |
|---|---|---|---|---|
| 2006/0208528 | A1 | 9/2006 | Tucker et al. | |
| 2007/0199214 | A1* | 8/2007 | McCormick | E02F 3/3677 37/468 |
| 2011/0209608 | A1* | 9/2011 | Stefek | E02F 3/3622 91/468 |
| 2011/0286788 | A1* | 11/2011 | Sikorski | E02F 3/3663 403/315 |
| 2012/0210614 | A1 | 8/2012 | McCormick et al. | |
| 2013/0164080 | A1* | 6/2013 | Miller | E02F 3/3604 403/373 |
| 2013/0318841 | A1* | 12/2013 | Robl | E02F 3/3622 37/468 |
| 2013/0322959 | A1 | 12/2013 | Robl et al. | |
| 2014/0159294 | A1 | 6/2014 | George | |
| 2014/0301779 | A1 | 10/2014 | Balemi | |
| 2015/0330053 | A1* | 11/2015 | Ravindran | E02F 3/3618 403/91 |
| 2016/0002877 | A1* | 1/2016 | Pesch | E02F 3/3677 37/468 |
| 2018/0148903 | A1* | 5/2018 | Hart | E02F 3/3627 |

FOREIGN PATENT DOCUMENTS

| | | | | | |
|---|---|---|---|---|---|
| EP | 2987916 | A2 | | 2/2016 | |
| GB | 1588308 | A | | 4/1981 | |
| GB | 2330570 | A | | 4/1999 | |
| JP | 2002524673 | A | | 8/2002 | |
| JP | 2018-091091 | A | | 6/2018 | |
| KR | 20010019689 | A | * | 3/2001 | E02F 3/36 |
| KR | 10-2009-0056125 | A | | 6/2009 | |
| KR | 2018/0001622 | A | | 1/2018 | |
| NZ | 572477 | A | | 1/2012 | |
| WO | WO-2016/195512 | A1 | | 12/2016 | |
| WO | WO-2018056841 | A1 | * | 3/2018 | E02F 3/36 |

OTHER PUBLICATIONS

Office Action dated Jan. 19, 2022 issued in corresponding Chinese patent application No. 201980043202.5.
Search Report for Great Britain Application No. 2302217.1 dated Feb. 24, 2023.
Examination Report for Indian Application No. 202117002739 dated Sep. 19, 2022.
International Search Report PCT/ISA/210 for International Application No. PCT/GB2019/051746 dated Feb. 3, 2020.
Written Opinion PCT/ISA/237 for International Application No. PCT/GB2019/051746 dated Feb. 3, 2020.
Great Britain Search Report for GB Application No. 1810408.3 dated Dec. 19, 2019.
Search and Examination Report dated Oct. 19, 2022, issued in corresponding United Kingdom Patent Application No. 1810408.3.

* cited by examiner

COUPLER

CROSS-REFERENCE TO RELATED APPLICATIONS

This application is a national phase under 35 U.S.C. § 371 of PCT International Application No. PCT/GB2019/051746 which has an International filing date of Jun. 21, 2019, which claims priority to Great Britain Application No. 1810408.3, filed Jun. 25, 2018, the entire contents of each of which are hereby incorporated by reference.

The present invention relates to a coupler for coupling an accessory to an excavator arm of an excavator. One such accessory could be an excavator bucket.

Couplers, also known as quick couplers, quick hitches or excavator couplers, for coupling accessories to the excavator arm of an excavator are well known in the art. The couplers generally comprise a top half that is connectable to an excavator arm using two attachment pins (via two pairs of holes provided for those attachment pins) and a bottom half for engaging two further attachment pins, on the accessory. In modern couplers, the bottom half typically comprises two jaws, rather than holes. Those jaws engage respective ones of those two further attachment pins of the accessory, and a closure mechanism for at least one of those jaws is provide, usually driven by a remote operable actuator, such as a screw-drive, or a hydraulic cylinder, operable from the cab of the excavator.

A common feature of many such couplers is that one of the two jaws is usually referred to as a front jaw. Its opening (for receiving a first or front one of the two attachment pins of the accessory) is generally directed out of a first end of the coupler. This first end is commonly referred to as the front end as it is the end that is guided first onto an accessory pin. The direction that the opening faces—the forward direction—lies generally parallel to an imaginary line joining the two pairs of holes in the top half of the coupler, as used for attachment of the coupler to the end of the excavator arm. Sometimes the direction that the opening faces is angled slightly upwards from that line, perhaps by up to an angle of up to 15° from parallel, but often it is nearly directly parallel to that line.

The second jaw is then usually referred to as a rear jaw, as it lies nearer the opposite, or back end of the coupler, albeit in the bottom wall of the coupler. It generally opens downwardly, i.e. in a direction that is generally perpendicular to the front jaw, or the imaginary line between the two pairs of holes in the top half of the coupler. It also may be off that perpendicular, perhaps by up to 15°.

The jaws from the side of the coupler appear singular, but often the jaws are bifurcated—especially the rear jaw, as there are working mechanisms inside the coupler, and they often need to be serviceable. Commonly they are formed integrally to the body of the coupler, although they can be made of harder steel than the main body of the coupler, and joined thereto during the production of the coupler.

For the purpose of this application we refer to the rear jaw and the front jaw, even though each jaw may have more than one element.

The rear jaw commonly has the closure member—an associated latching member. For most couplers this is described as a hook or a closure plate. The latching member can be slid or pivoted between a latched position and an unlatched position by using the actuator. In the latched position, the opening of rear jaw is at least partially closed by the latching member. In the unlatched position, the latching member is retracted out of the latching position so as to leave the jaw's opening as open as needed to allow the second attachment of the accessory to be located therein. This may be a full retraction to completely clear the opening of the rear jaw, or a less complete retraction wherein the opening of the jaw is only partially obscured, but less than in the extent needed for latching position for a particular accessory (different accessories may have different pin spacing, so often there is a degree of variance in the latching position during use of a coupler.

The unlatched position is both for allowing upward insertion of the second attachment pin in the rear jaw, and for allowing a previously captured attachment pin to be removed from the jaw downwardly.

The insertion or removal of the second attachment pin is usually achieved by rotating the coupler to drop or lift the rear jaw relative to the front jaw. During this process, it is best if the accessory has previously be laid on the ground so that it cannot drop off the coupler.

As indicated before, sometimes it is enough just to retract the latching member out of the way of the attachment pin, rather than all the way out of the jaw.

Secondary locking devices are also often provided for these couplers. For example, the coupler in GB2330570 also features a blocking bar which is adapted to fall under the influence of gravity into a blocking position in front of the latching member—in that case a pivoting latching hook. In that blocking position, the blocking bar will resist the unlatching of the latching hook, even in response to operation of the hydraulic ram as provided for that purpose, by blocking the hook's path from its latching position into an unlatched position. The blocking bar achieves that position when the coupler is in a normal, in-use, orientation of the coupler, i.e. most non-inverted orientations.

The blocking bar is pivotally mounted about a pivot. That pivot is positioned near the front jaw. The blocking bar therefore points generally towards the rear jaw from that pivot and is balanced about that pivot such that gravity will usually urge it towards its blocking position, i.e. while the coupler is in the normal, in-use, orientation rather than upside down or partially inverted. Then, in order to unblock the latching hook (for decoupling the accessory from the coupler), either the coupler would need to be inverted or else some form of urging means would be provided for lifting the blocking bar from its blocking position into a non-blocking position. One such urging means could be a small hydraulic ram.

Due to the configuration of the elements of the various moveable components in these couplers, the latching and unlatching actions, for attaching or detaching an accessory to the coupler (on the end of an arm of an excavator), typically have to be performed using a series of predefined steps, upon which the design of the mechanisms enable cooperation with each other for the latching or unlatching processes. This is important so as to prevent inadvertent detachment, or to ensure appropriate attachment—an incorrect attachment can result in an unexpected detachment, or damage to the components of the coupler. What would be desirable, however, would be to provide a coupler, or a system involving a coupler, in which both jaws are able to secure a respective pin, but in which a more simple or fool proof set of predefined steps can be employed for the attachment and detachment procedures, but while still maintaining a safe securement and retention of an accessory, a safe detachment process, and even a safe attachment in the event of a "pin miss" on either the front jaw or a rear jaw.

According to a first aspect of the present invention there is provided an excavator coupler comprising a housing with a top part for attachment to an excavator arm of an excavator, and a bottom part for attachment to an accessory for the excavator, such as an excavator bucket, the bottom part comprising a front jaw open to a front of the coupler for receiving a first attachment pin of an accessory and a rear pin receiving area open to a bottom of the coupler for receiving a second attachment pin of the accessory, the coupler further comprising a latching member for the rear pin receiving area, the latching member comprising a body, a further jaw extending below the body, a release member extending forward of the body, an attachment point for an end of an actuator and a hole through the body into which a sprung member is located, wherein the sprung member extends through and to under the body and into or partially across a mouth of the further jaw. In use, the sprung member serves to hold or retain an attachment pin of an accessory in the mouth of the further jaw so as to prevent release of that attachment pin in that further jaw in the event of a hydraulic failure of the cylinder by preventing retraction of the latching member out of the rear jaw.

Preferably the rear pin receiving area is a rear jaw that is open to a bottom of the coupler.

Preferably the attachment point is part of, or associated with, an actuator or hydraulic ram receiving formation into which the head and/or cylinder of the actuator or ram is accommodated. Alternatively it may be part of, or associated with, an actuator or piston receiving formation into which a distal end and possibly a shaft of the actuator or piston is accommodated.

Preferably the further jaw comprises a top wall, a back wall and a bottom wall, with its opening, opposing the back wall. Preferably the opening is directed in an opposite direction to the front jaw, i.e. towards the rear of the coupler.

To further assist the resistance to retraction of the further jaw, usually towards the front of the coupler, the bottom wall of the further jaw comprises a lip at its free end. The lip is preferably defining an upwardly angled slope that will resist the exit of a pin from the grasp of the further jaw.

Preferably the further jaw comprises an angled slope leading from the back wall of the further jaw towards the free end of the further jaw at the end of the bottom wall, the angled slope defining a back part of the bottom wall, and on which the second accessory pin will sit upon closure of the rear pin receiving area.

Preferably the angled slope is combined with the lip to define a depression, or they are spaced apart enough to define a recess, into which the second attachment pin of the accessory can rest in the event of a retraction of the further jaw, out of which the accessory pin would need to lift in order to clear the lip.

Preferably the sprung member 44, by being at or near the mouth of the further jaw, will engage with another part of the circumference of the second attachment pin of the accessory at least when the second attachment pin sits in the depression or recess, thus resisting such a lifting of the accessory pin, during involuntary retraction of the further jaw.

Preferably the sprung member has an end face that is tapered, angled or rounded at the point at which it attaches the second attachment pin, such that the second attachment pin, when engaging the sprung member, will impart a sideways or angled force component on the sprung member, so to encounter a larger force of resistance to compression of a spring member of the sprung member than would be present if the force was applied axially along the sprung member, thus giving the sprung member the capacity to provide increased resistance to lifting than the spring force of the spring bias behind it.

In place of the angled slope of the further jaw, or in addition thereto, a pin receiving recess may be formed in the lower wall of the further jaw, to provide the same purpose. However, the angled slow serves a purpose when there is no retraction of the further jaw: the angled slope of the further jaw serves to maintain the second attachment pin in engagement with the top wall of the further jaw, or the top wall of the rear pin 30 receiving area if lower, during the retention of the second attachment pin in the rear pin receiving area.

The biasing device for the sprung member may be a coil spring, a rubberised member, a compressible gas or any other form of biasing device, intended to default the sprung member into its extended state through and to under the body and into or partially across a mouth of the further jaw.

The present invention also provides an excavator coupler comprising a housing with a top part for attachment to an excavator arm of an excavator, and a bottom part for attachment to an accessory for the excavator, such as an excavator bucket, the bottom part comprising a front jaw open to a front of the coupler for receiving a first attachment pin of an accessory and a rear pin receiving area open to a bottom of the coupler for receiving a second attachment pin of the accessory, the coupler further comprising a latching member for the rear pin receiving area, the latching member comprising a body, a further jaw extending below the body, a release member extending forward of the body and an attachment point for an end of an actuator, further comprising a second latching member for the front jaw, the second latching member comprising a hub that is mounted for axial rotation about its axis, the hub having extending therefrom a front jaw blocking member and a release surface, the release surface angled away from the front jaw blocking member, the release surface being for engagement by, or indirectly by the release member extending from the body of the first latching member, wherein the rotation axis for the hub is located nearer the front of the coupler than the attachment pin seated position of the front jaw and the second latching member is spring biased into a front jaw blocking position in which the front jaw blocking member extends at least partially across the opening or mouth of the front jaw.

Preferably the hub is provided as a tube or barrel onto which the additional parts are formed, moulded or mounted. The hub, tube or barrel of the second latching member can be pivotally mounted onto the frame by an axle pin.

This second aspect may also include the features of the first aspect whereby it also comprises a hole through the body of the first latching member into which a sprung member is located, wherein the sprung member extends through and to under the body, and into or partially across a mouth of the further jaw, or any of the other above described features of that first aspect of the invention.

The second latching member may be biased into its blocking position by means of a tension spring mounted between a flange extending from the hub, or some other part of the second latching member, and a fixed mounting position on the coupler housing, or the actuator.

Preferably the fixed mounting position is provided by a pin extending through the housing's side wall.

In accordance with a third aspect of the present invention, in place of the tension spring, the hub is provided with a square section along at least a part of its length, which square section is mounted within a larger square tube or formation with a variable relative angle of rotation, but a default relative angle of rotation of about 30°, with elastically deformable members provided in the four corners of the larger square to provide that default relative angle, the elastically deformable members bearing against the outside faces of the square section of the hub and the inside corners of the larger square. This arrangement effectively forms a Rosta (RTM) type spring, whereby the hub can rotate about its axis in opposition to the spring bias formed by the elastically deformable members.

Instead of 30°, other angles are possible, dependent upon the amount of torsion desired to open the jaw—the deformable members provide additional resistance to torque, the more the inside rotates relative to the outside.

The outer square may be formed by a square section component or by mounting three square sides onto a flat surface.

A square Rosta (RTM) type spring is good for the purpose of the invention, as the amount of rotation of the hub during the use of the coupler will not exceed 90 degrees.

For alternative torsion bar types, a triangular section, or a polygonal section of more than 4 sides may be used instead—e.g. for the inner and outer shapes. However, four sides is found to be the most effective solution as it gives a wide enough angle of rotation—about 60° (30° in each direction from the default position).

Preferably the axis of the hub is a fixed axis relative to the coupler housing.

Preferably the cylinder's piston has its free end fixedly mounted to the housing, and the cylinder head, at the other end, is attached to the first latching member.

Preferably the first latching member is a slidable latching member, with the body arranged to slide relative to the coupler housing in a forward and rearward direction. This may be provided by providing tracks in one of the housing and the first latching member, and a rail or sliding member in the other thereof.

Preferably the top wall of the further jaw is nearer the top part of the coupler than a top wall of the rear jaw. The free end of the sprung member 44 then extends below that upper wall of the rear pin receiving area when in its extended position.

Preferably the upper wall of the rear pin receiving area is substantially planar, with the first latching member being a sliding latching member.

Alternatively the upper wall of the rear pin receiving area is convexly curved about a central part thereof, as viewed from the side of the coupler, with the first latching member being a pivotal latching member, preferably with the radial centre of the convex curve falling at the hinge axis of the first latching member.

Preferably the front jaw has a recess in its bottom surface with a lip at the free end thereof, whereby the first attachment pin of the accessory, when in that jaw, can descend into the recess and would thereafter need to rise out of it in order to exit over the lip.

These and other features of the present invention will now be described in further detail, purely by way of example, with reference to the accompanying drawings in which.

Figure 1:
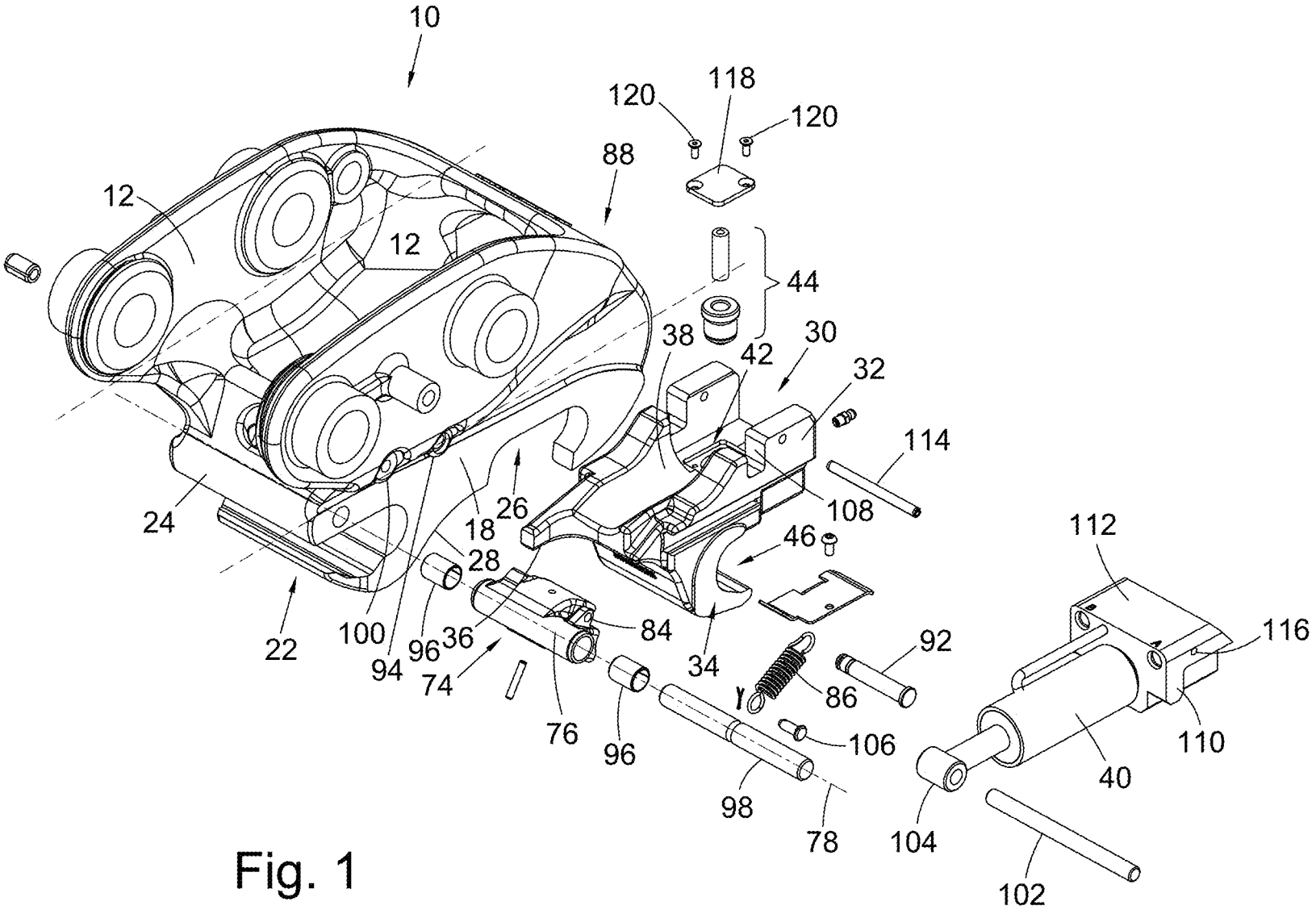
FIG. 1 shows an exploded view of an example of a coupler in accordance with the present invention comprising the first and second aspects of the present invention.

Referring first of all to FIG. 1, there is shown an exploded view of a coupler in accordance with the first and second aspects of the present invention. The coupler 10 comprises a main housing 88 having a top half 12 and a bottom half 18.

The top half has a pair of attachment holes for attaching the coupler to an excavator arm of an excavator using a first and second excavator arm pins (not shown).

The bottom half 18 instead has two jaws 22, 26 with a first jaw 22 being positioned to be open to the front 24 of the coupler whereas the second jaw 26 is open to the bottom 28 of the coupler 10. The second jaw is commonly referred to as the horseshoe, although it can have different shapes, including a narrower opening, a wider opening or a single side—for a more variable accessory capacity, as this is a rear pin receiving area and the rear pin may be at a wider or narrower spacing from the first attachment pin of the accessory, dependent upon the size or manufacturer of the accessory.

The illustrated jaw is wider than it is deep, whereas the first jaw is deeper than it is wide. The rear jaw is wide so as to be useable on multiple different accessories, some of which have different pin spacing. Such a width—perhaps at least 2× the depth at the deepest part, is useful.

As FIG. 1 is an exploded view, the internal components of this coupler 10 are shown exploded away from the coupler housing 88. These components include a first latching member 30, a second latching member 74 and a hydraulic ram or cylinder 40.

The first latching member 30 is for latching an accessory pin in the rear jaw 26, whereas the second latching member 74 is for latching a pin in the first jaw 22. The hydraulic cylinder 40, hydraulic lines for which are conventional in the art but not shown, is for powering the movement of the first latching member 30, which in this embodiment moves slideably within the coupler housing 88 between a latched condition in which a further jaw 34 of the first latching member engages against a latching pin to a release condition in which the further jaw 34 is pulled away from that attachment pin, in this embodiment by moving the latching member 30 closer to the front of the coupler 10. It is thus commonly referred to as the actuator. Other forms of actuator, such as pneumatic or screw-drive actuators, can instead be used.

Additional components include bearings and a pivot pin 98 for the second latching member 74 for pivotally mounting the second latching member 74 above and in front of the pin seating position of the front jaw such that it has a fixed axis 78 relative to the coupler housing 88, a piston pin 102 for fixedly mounting the free end of the piston 104 in the coupler housing 88 by locating the piston free end 104 inside the housing and then pushing through the piston pin 102 through the holes 100 in the side wall of the coupler housing, a fixed mounting position forming pin 92 for passing through another hole in the side wall of the coupler 94 and a tension spring 86 for hooking onto a fixed mounting portion 90 of the pin 92 at one end, and a flange 84 of the second latching member 74 at the other end. It can be affixed thereto at the other end by a further pin 106, as per this example. That further pin 106 may be press fitted or screwed into a hole in the flange 84. Other means of attachment means may be provided such as a grooved fixed pin onto which the eye of the tension spring can be affixed, much like on the fixed position pin 92.

As for the first latching member 30, it has a hydraulic ram or piston receiving formation 38, which in this case is a generally semi-circular recess for receiving the cylindrical barrel of the cylinder 40 and a flanged receiver 108 for engaging with flanges 110 in the head 112 of the cylinder 40. In this embodiment there is a flanged receiver on both sides of the semi-cylindrical formation 38 for receiving flanges 110 on either side of the head 112 of the cylinder 40. The distal end of the piston 104 will then be mounted to the housing at a fixed position.

In an alternative embodiment, the cylinder and piston may be reversed so that the head of the cylinder is fixed to the housing 88 and the free end of the piston 104 is instead mounted on the first latching member 30.

In the illustrated embodiment, once the flanges 110 are inserted into the flanged receivers 108, a securement pin 114 can be used to lock it in place. For this purpose, a through hole 116 is provided through the head of the cylinder 112 and the sides of the flanged receiver.

In the semi-cylindrical receiving formation 38 of the latching member 30 there is also a hole in the base thereof extending through to a mouth 46 of a further jaw 34 of the first latching member 30 into which, and out through the end of which, a sprung member 44 can be inserted. As shown, the sprung member 44 includes a flanged cylinder with a tapered or rounded end face 68, the flange preventing the sprung member 44 from exiting out through the bottom of the hole 42. There is also a spring or biasing means for positioning within that sprung member for creating a biasing force for it. Preferably the biasing force within the sprung member is in the order of 50 to 400N. Typically the spring force will be tailored for a particular coupler, although perhaps the spring force is in the order of 50 to 100 Newtons for a mini coupler, with working loads not exceeding 6,000 kg, between 80 and 200 Newtons for a midsize coupler, with working loads not exceeding 12,000 kg, and perhaps between 150 and 300 Newtons for a large coupler with working loads not exceeding 22,000 kg. It will be appreciated though that the spring force required will depend on the geometry of the sprung member, the body and the hook, along with the mass off the hook assembly and the accessory loading on the coupler, e.g. a bucket either when empty, or under no load, or when fully loaded with soil. Preferably the spring force, however, is large enough to carry the working load of the accessory, but low enough to be overridden by the actuator driving the first latching member into its open configuration.

Finally a capping plate 118 is attached down onto the top of the hole to close it and thus lock the sprung member 44 in and partially out through the bottom of the hole. At least two screws are provided for the purpose of locking down that capping plate. Two of the screws 120 are shown.

The body of the first latching member 30 also has extending from its forward end a release member 36. That release member 36 is provided for interaction with the mechanism for releasing the second latching member 74. In this embodiment, this is achieved by the free end of the release member 36 directly engaging a release surface 82 provided on the second latching member 74. In this embodiment, that release surface 82 is separate to the flange 84 onto which the spring 86 is attached.

The second latching member 74 additionally comprises a front jaw blocking member 80, which in this embodiment is positioned between the flange 84 and the release surface 82, such that the three features are spaced along the length of a barrel 76 of the second latch member 74. It would be possible, however, for two or more of these components to be amalgamated into a single structure on the hub 76.

Figure 2:
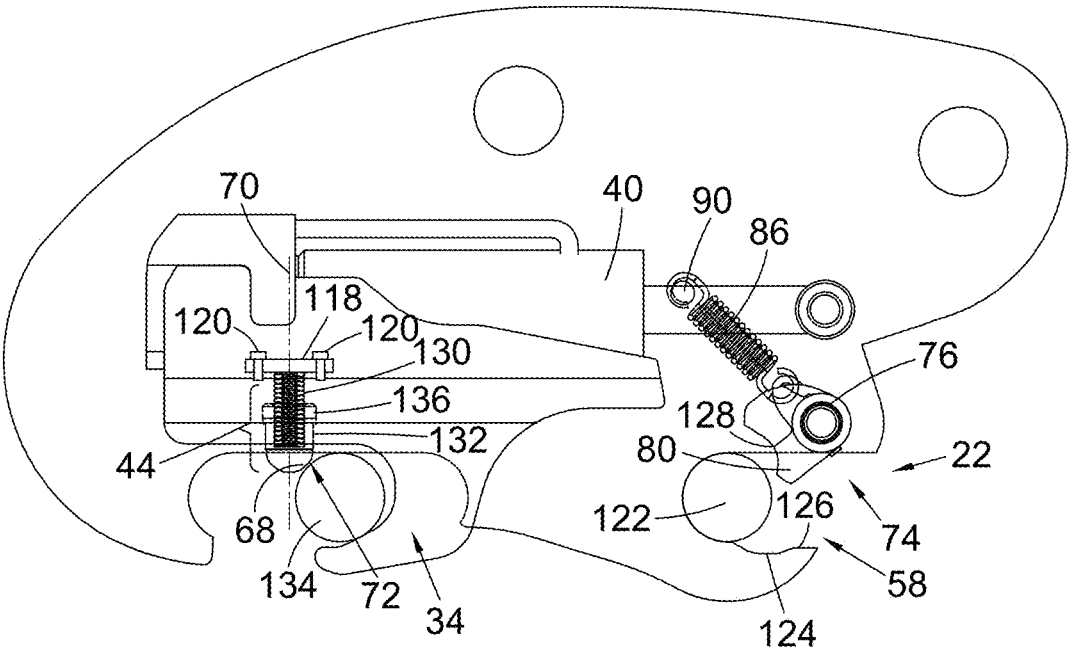
FIGS. 2 to 8 show a further embodiment of the present invention comprising the first and second aspects of the present invention and illustrating a sequence of operation thereof, from an engaged condition through to a released condition and from an engaged condition through to partially released, but still tethered, conditions.

An example of a coupler similar to this first embodiment, just from a side view, is shown in FIG. 2. As can be seen, a front jaw blocking member 80 defaults under the tension of the spring 86 into a position in which it partially extends across the mouth 58 of the front jaw 22. It is held there by the tension of the spring 86 which acts to pull the flange 84 into alignment with the axis of the spring 86. As the flange 84 extends generally perpendicular to the front jaw blocking member 80, and given the position of the barrel above and in front of the first attachment pin 122 of an attachment, the now slightly rearward and downwardly directed front jaw blocking member extends partly across that mouth 58 so as to prevent removal of the first attachment pin 122 from the front jaw 22, if it was to be allowed to move that way by the second attachment pin, in the rear pin receiving part, being likewise allowed to move (the two pins, of course, are at a fixed spacing as they are part of the structure of the accessory).

The free end of that front jaw blocking member 80 is also arranged so that should the first attachment pin 122 be attempted to be removed from that jaw 22, it thus engaging that blocking member, the second latching member 74 will tend to rotate into a more closed condition.

Figure 6:
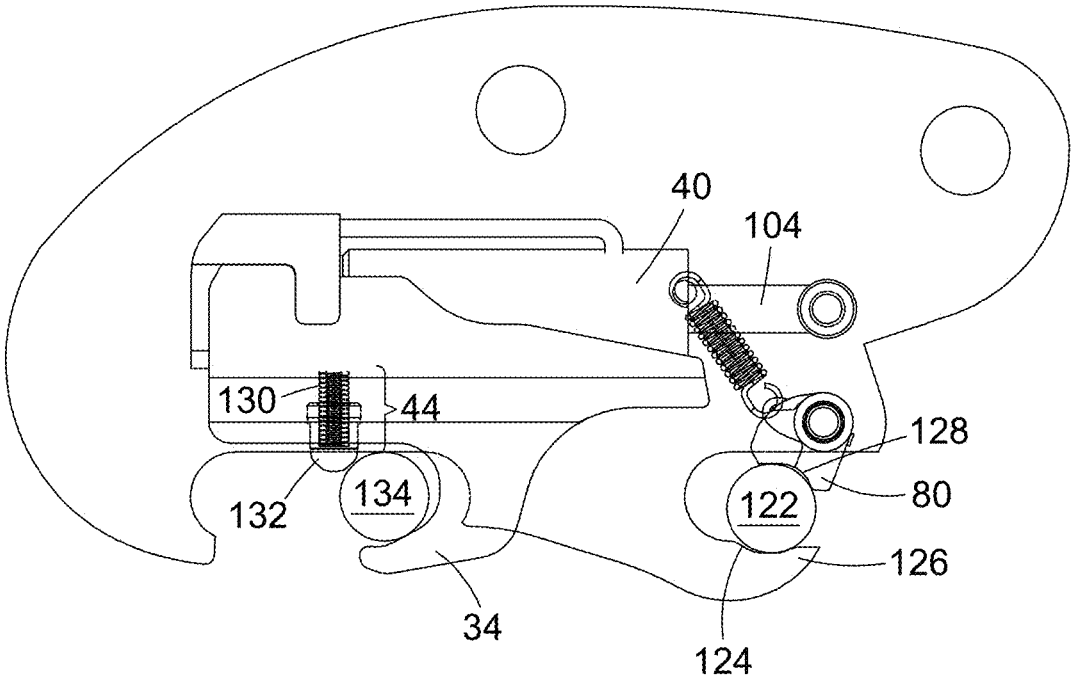
Figure 7:
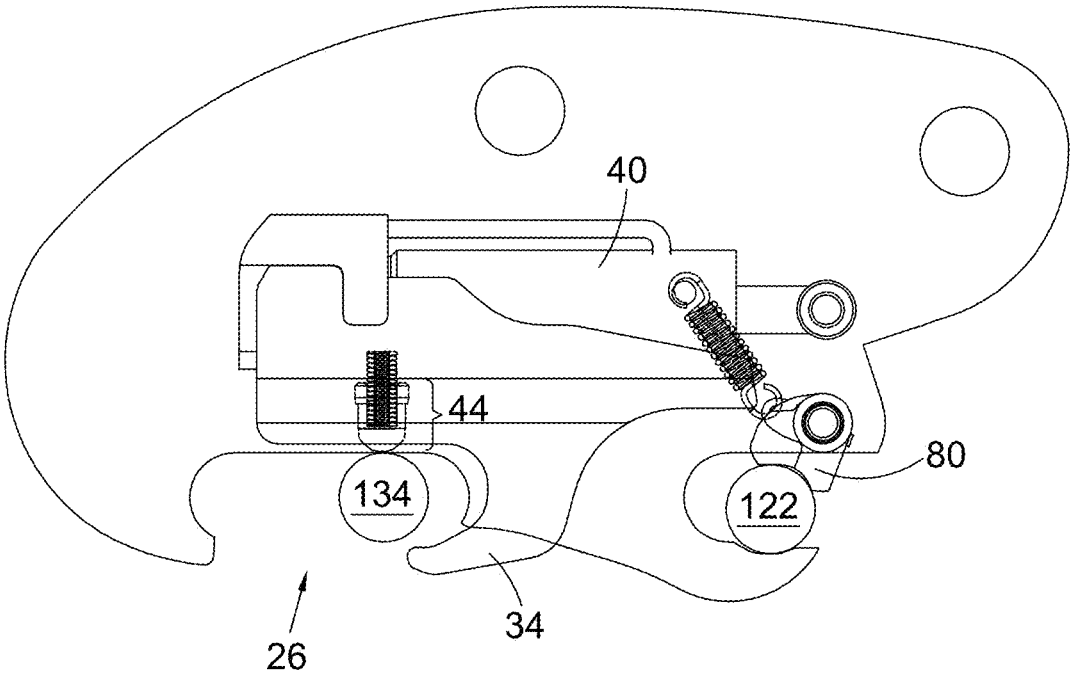
Figure 8:
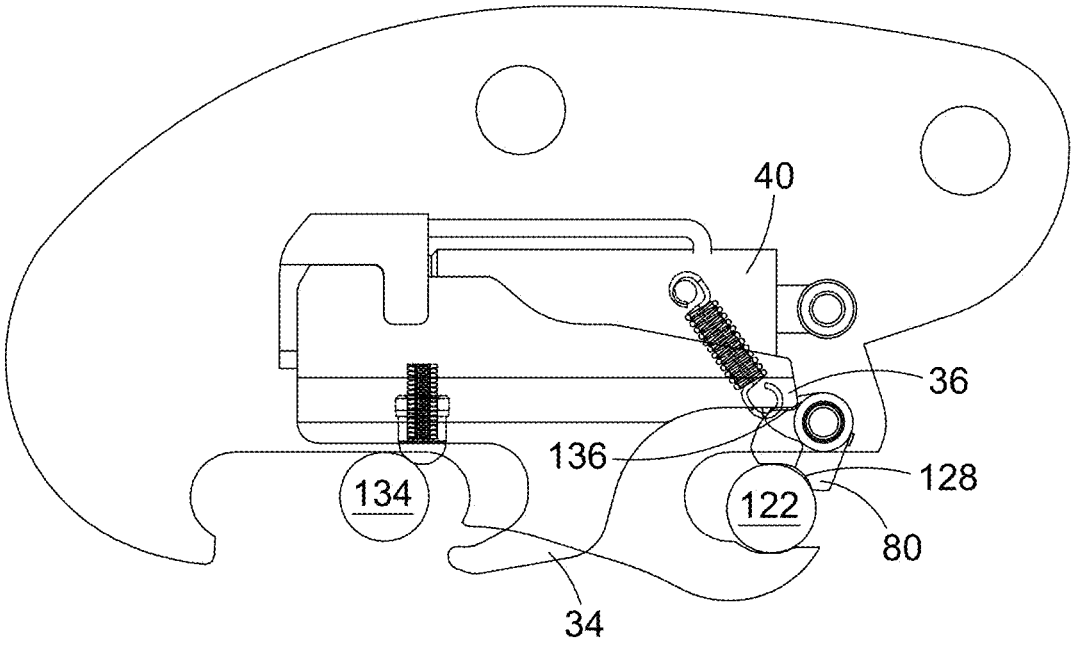
Figure 9:
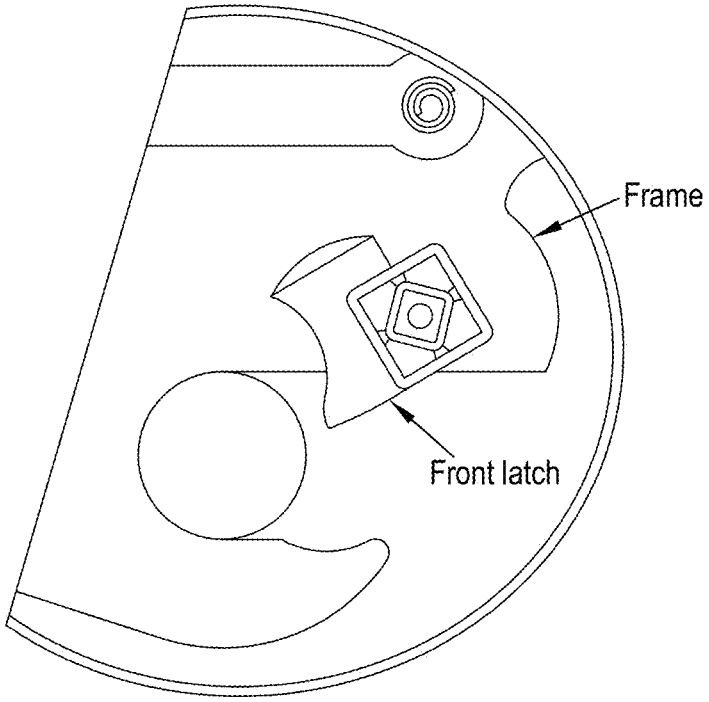
FIG. 9 shows an alternative form for the second latching member, showing an example of a Rosta type spring for the second latching member in accordance with the third aspect of the present invention.

As known in the art, the second latching member will have flanges or surfaces thereon which interact with elements or surfaces on the coupler housing 88 to restrict rotational movement of this second latching member so that it will allow degrees of rotation of perhaps no more than 50 to 90° between fully blocking and fully open. Its default rest position, however, may be 20 to 45° from the fully open position, whereby a degree of rotation of 30° may be enough. More usually, though there is the illustrated ability to further block the opening as this can then offer an additional benefit as discussed below, and as shown in FIG. 6, 7 or 8. In this embodiment, the degree of rotation is closer to 60°. Usually a range of movement of between 50 and 90° is enough.

As shown in FIGS. 6 to 8, the front jaw blocking member is provided with a curved surface accessed by the attachment pin when the front jaw blocking member deploys from its default position into an additionally blocking condition. That curved surface is arranged to partially cup the attachment pin, which then holds or secures a blocking of the attachment pin 122—the blocking member can neither open nor close further while the weight of the pin and accessory is on the blocking member as the two points of contact from the cup resist such movement. This can even cooperate with a recess 124, when provided towards a free end of the lower part of the front jaw 22, which recess is terminated by a lip 126 towards the free end of that lower part of the jaw 22. This is because the cupped portion pushes down the pin 122 into that recess 124. The cupped portion 128 pushing that attachment pin 122 into the recess 124 is shown in FIGS. 6, 7 and 8. With this arrangement, the pin cannot exit the front jaw 22.

Referring again to FIGS. 2 to 8, the function of the sprung member 44 will now be further described.

Figure 3:
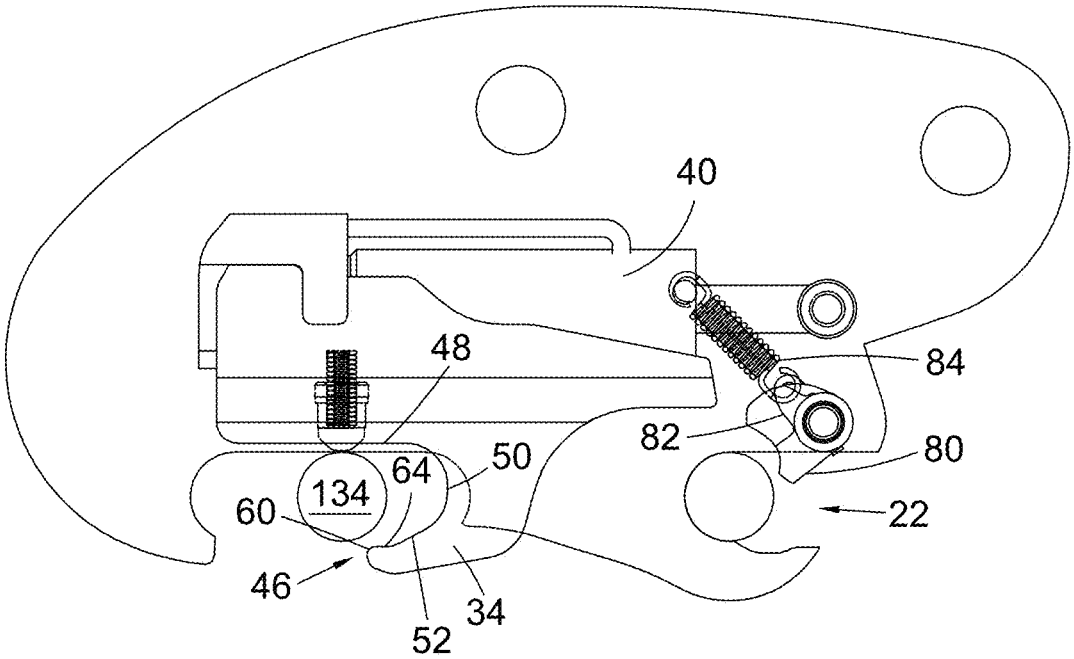
Figure 4:
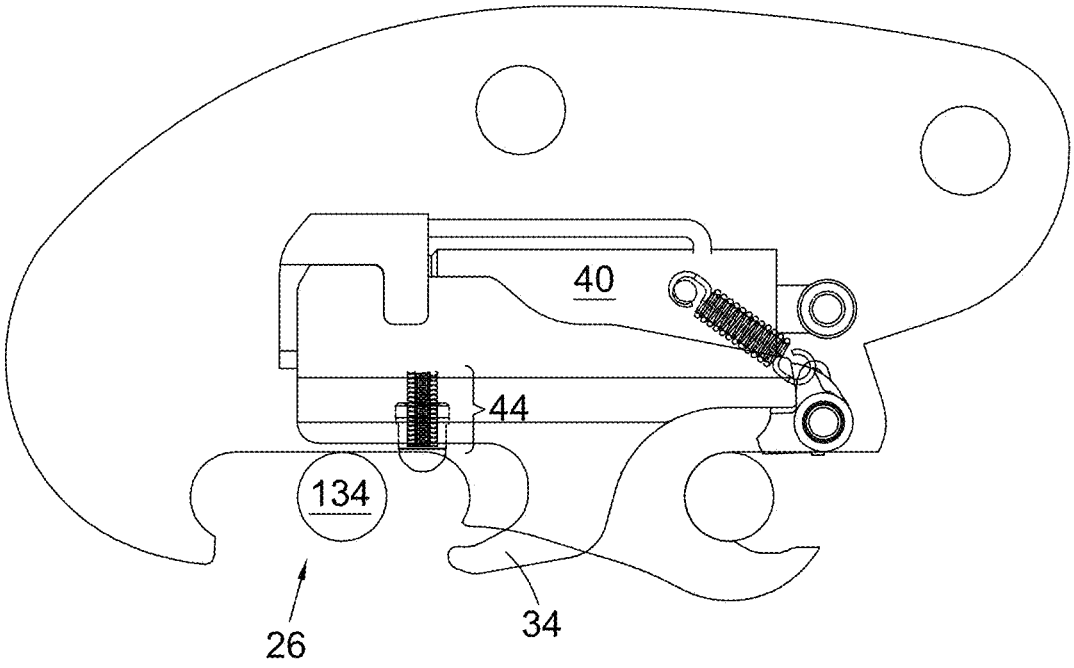
Figure 5:
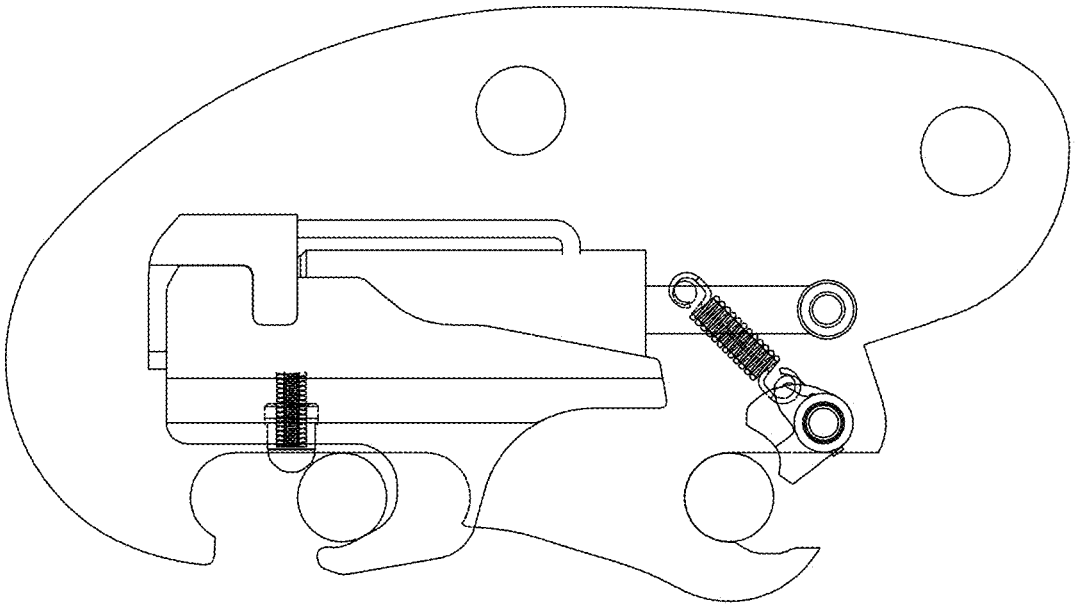

Referring next to FIGS. 2 to 4, operation of the sprung member 44 is shown. In FIG. 2, the capping plate 18 and the screws 120 for retaining it are illustrated. However, for clarity, these additional elements are omitted in FIGS. 3 to 8. It will also be appreciated that other ways of providing a sprung member in this position is possible.

As can be seen, in this embodiment the sprung member 44 is retained by the capping plate 118, and comprises an inner spring 130 and an outer member 132, which outer member is adapted to extend beyond and into the rear jaw of the coupler for engaging or nearly touching a second attachment pin 134 of the accessory when the accessory is fully attached in the coupler. There may be a space between the second attachment pin 134 and the sprung member 44 if the second attachment pin has a smaller diameter, or if the pin sits deeper into the jaw. Alternatively, the sprung member may not be quite as far extended into the rear jaw. In this embodiment, however, the accessory pin 134 and the sprung member are sized, shaped and positioned such that the pin contacts that extended sprung member when the accessory, and its pins, are tightened into the coupler. Ideally the sprung member would be biasing against the pin, for positive engagement thereof.

The sprung member 44 comprises the spring and the outer member 132 held into a biased outward position by the engagement of the capping plate 118 with the upper end of the spring 130. Shoulders of the flange 136 around the top of the outer member 132 prevent full escape of the outer member 132 through the rear jaw as their shoulders engage on the top edge of the hole through which the outer member extends.

In this embodiment, the spring 130 is shown to be a coil spring. The coil spring has a high compressive force to ensure a default extended position for the outer member. Preferably this force should exceed 50N. For example it might be between 50N and 400N. As before though the chosen force will be appropriate for the geometry of the coupler and the accessory to be used therewith, to allow retention of the accessory, but overriding of the force by the actuator 40.

The distal end or free end of the outer member 132 provides an end face 68 which has a tapered or rounded surface. The tapered or rounded surface facilitates a clicking in of the second attachment 134 into the further jaw 34 upon extension of the cylinder 40. Further, it allows the additional extension of the sprung member into the rear jaw to aid in retention of the second pin 134.

The further jaw of the latching member 30 is provided with a top 48 (see FIG. 3), a back 50 and a bottom 52. The top in this embodiment is located above the top of the second jaw. These may be flush, however. The back is curved to give the further jaw 34 a hook like appearance. Other shapes are possible, but this curve reduces stress concentrations.

The bottom 52 comprises three areas-first an angled slope which extends rearwardly with an opening taper before then curving up to form a tip or lip 60. The change of direction thus forms a recess 64, which recess allows an attachment pin 134 to catch in the recess. The recess can be wider or narrower than illustrated though, perhaps with different side angles, or a longer bottom part.

In use, if there is a tendency for the first latching member to creep towards a jaw opening condition, then this would likely try to release the attachment pin out of the further jaw, by it initially falling down the angled slope, and it then passing through the recess and potentially over the tip or lip. However, that movement would at least partially be against the bias of the sprung member, and the bias-force would be increased upon any attempt to lift the pin over the lip or out of the recess. With the force provided by the sprung member, an equilibrium would be found, whereupon the creep would stop.

This action, together with the second latching member resisting exit of the first attachment pin from the first jaw, means that upon the creep stopping, a detachment of the accessory will be prevented, even if the hydraulics of the cylinder fail.

Instead of a coil spring 130 for the sprung member, there could be provided a rubberised spring in which compression thereof widens the walls thereof, thus closing the inner dimension. Such an arrangement is shown in FIG. 1.

As shown in FIGS. 2 to 4, a release of an accessory is still possible. From an attached pin condition of FIG. 2, the hydraulic cylinder 40 can be contracted to pull the piston into the cylinder, and thus the first latching member 30 towards the front of the coupler. The additional forces provided by the hydraulic cylinder or actuator, will be enough to draw the sprung member 44 into a compressed state and over the top of the attachment pin 134. This naturally compresses the spring 130 as shown in FIG. 3. Further retraction of the piston of the cylinder 40 ultimately arrives in a full retraction of the first latching member, as shown in FIG. 4, in which the sprung member 44 has cleared the second attachment pin 1 and re-extended. By retracting the further jaw enough, the pin can then exit that second pin receiving part.

In this embodiment, the full retraction of the cylinder 40 pulls the further jaw almost clear of the rear jaw 26, but not fully clear. Other embodiments may allow it to pull further or less, but it should pull far enough to release the accessory pins of any accessory intended to be used with the coupler.

It will be appreciated from the above that the resistance to compression of the sprung member 44 provides a protection against the cylinder failure.

The coupler also offers other modes of protection.

In FIG. 6, one mode of failure is shown. It still retains the accessory so it is a secured failure mode. In this example, the sprung member 44 retains the second attachment pin 134 in the further jaw 34 as the hydraulic cylinder 40 pulls in its piston 104. As it does so, the first attachment pin 122 slides forward within the front jaw 22 to engage against the front jaw blocking member 80, thus rotating the front jaw blocking member 80 into its fully extended condition, blocking further exit of the first attachment pin 122 as that attachment pin cannot get past that front jaw blocking member. Additionally, the pin 122 can drop into the recess 124 behind the lip 126 of the front jaw 22, if provided (as shown here). To ensure this occurs, the spring 130 for the sprung member 44 needs to be stiffer and more resistant to movement of the outer member 132 than the front jaw locking member is, by making the spring force from the tension spring 86 of the second latching member 74, or the relevant Rosta spring of the embodiments of FIGS. 9 to 13, less forceful than the inner spring 130.

Referring next to FIG. 7, a continuance of the pulling back of the piston into the cylinder 40 is shown. Herein the further jaw 34 continues to be pulled forwards (i.e. towards the front of the coupler) by virtue of the free end of the piston being fixed to the coupler housing, and its other end being drawn further into the cylinder, so the sprung member 44 thus has to compress to allow the second attachment pin to start to release from the rear 26. In this Figure, however, the first attachment pin 122 still remains engaged against the front jaw blocking member 80, and thus that pin still won't release.

Referring next to FIG. 8, the continued drawing in of the piston into the cylinder 40 is occurring, thus pulling the further jaw 34 adequately forward to allow the second attachment pin 134 to be free to rotate out of the rear jaw, in this case around the central axis of the first attachment pin 122 as the first attachment pin remains captured in the cupped portion 128 of the front jaw blocking member 80. Furthermore, that further advancement of the first latching member 30 towards the front of the coupler has brought forward the release member 36 into engagement with a reverse side of a flange of the second latching member 74, in this case the back of the member that provides the release surface 82. As the release member 36 now lies behind that reverse side 136, rotation of the second latching member 74 in a direction to open the front jaw is now prevented, whereby the front pin is now captured within that front jaw, thus still keeping the accessory tethered to the coupler.

The present invention this enables an accessory attached to the coupler to be releasable only by a proper procedure, as per FIGS. 2 to 4—it cannot be released from the coupler in the event of an improper use of the cylinder, or the failure of the cylinder. Only with the interaction of the floor, and the use of the power of the cylinder, can the accessory be released from the coupler by using the hydraulic pressures of the cylinder 40 to overcome the spring bias of the sprung member 44 while retaining the first attachment pin 122 in the back of the front jaw 22 as per FIGS. 3 and 4.

Referring next to FIGS. 9 to 13, instead of the tension spring 86 used to hold the second latching member 74 in its blocking condition, a Rosta type spring is provided wherein the barrel 76 of the second latching member is provided with a square section along its length, which square section is mounted within a square cage, rotated 45° relative thereto, with the corner gaps internal of the outer cage being filled with rubber elements 144. The rubber elements 144, by being in the corner gaps 142, bear against the flat sides of the square section 140 of the barrel and against the corner or two side intersecting walls of the outer cage 138 to provide a rest position in which the square section 140 of the barrel 76 defaults to a condition approximately 45° rotated relative to the square outer cage 138.

Instead of the outer cage 138 being a square, it could be three sides attached to a flat face of the assembly comprising one or more of the flange 84, the front jaw blocking member 80 or the member comprising the release surface 32 and/or the reverse side 136.

Figure 10:
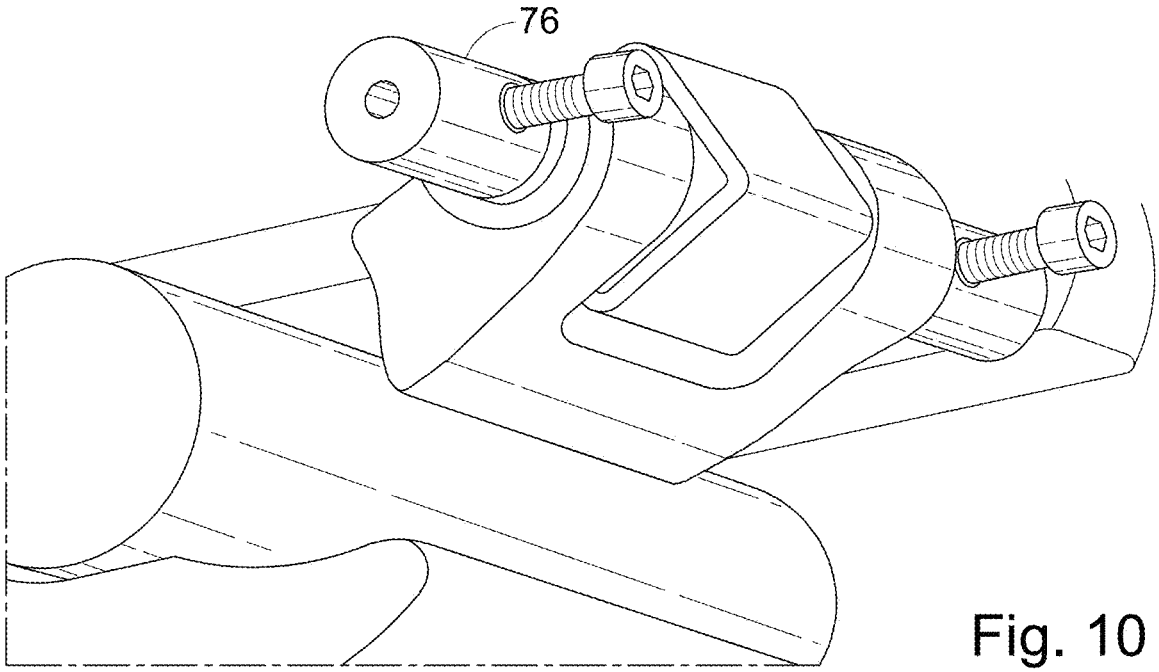
FIG. 10 shows a further view of an example of a Rosta type spring mounted on the second latching member.
Figure 11:
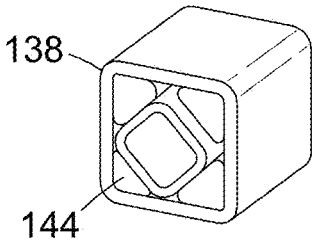
FIGS. 11 to 13 illustrate the operation of a Rosta type spring.
Figure 12:
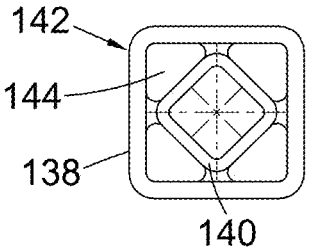
Figure 13:
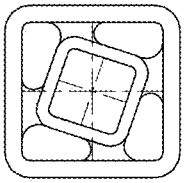

As shown in FIGS. 11 to 13, this arrangement of spring allows rotation of the inner square section relative to the outer square cage by compression of the rubber elements, which compression creates a return biasing force to return the square section to its original condition. In the present invention, this original condition would be the blocking condition as shown in FIG. 10. This thus allows the same rotation beyond that default condition into a further blocking condition and a release from that blocking condition into a non-blocking condition. With similar rotation limiting features incorporated into the coupler housing to prevent rotation beyond the previously described and discussed 50 to 90°, this Rosta-type spring provided an elegant solution for the coupler of the present invention.

Figure 14:
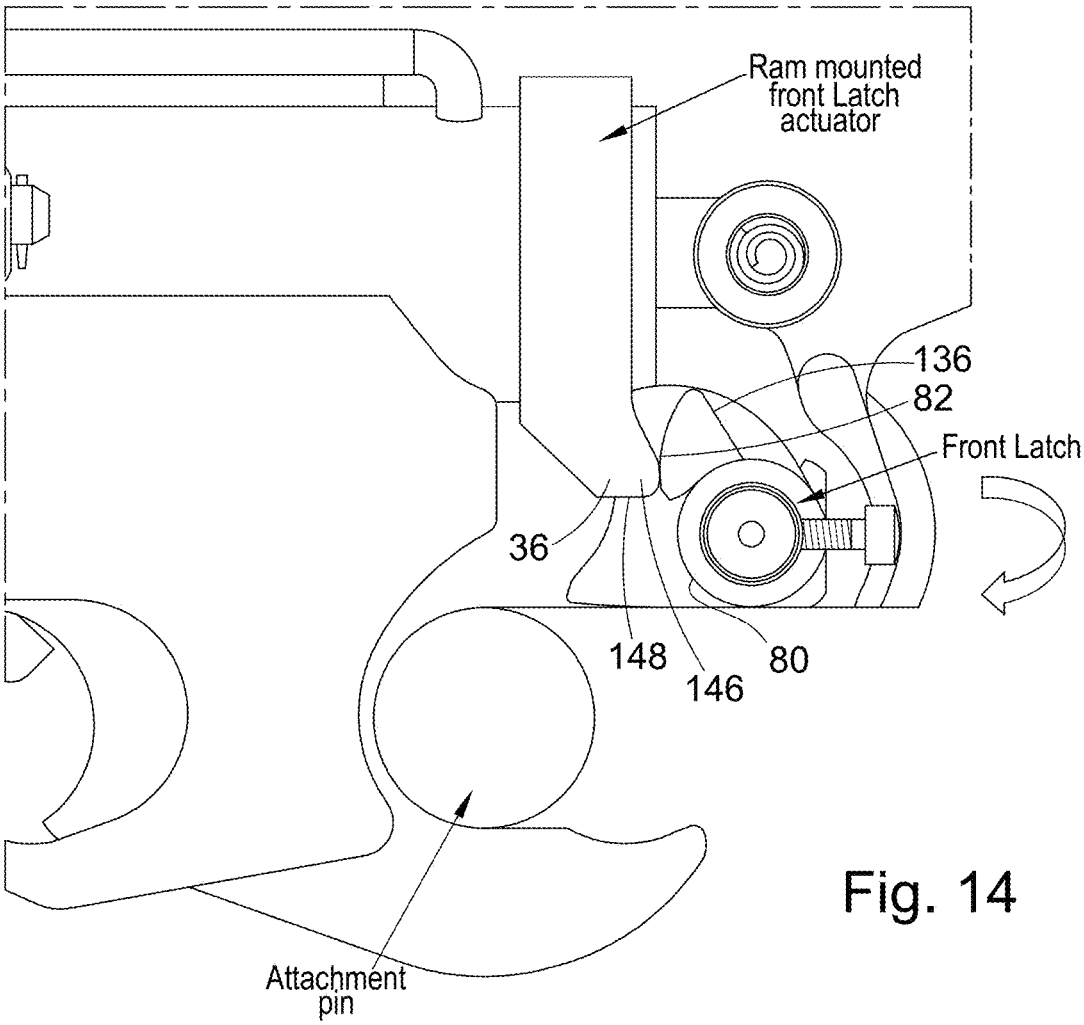
FIG. 14 shows an example of a further design of release member for the second latching member.

Referring next to FIG. 14, an alternative arrangement for the release member 36 is provided. In this embodiment, the release member 36 is a flange extending from the side of the cylinder, with a forwardly pointing tip 146. This forwardly facing tip wraps around to a flat underside 148, whereby the tip 146 can push against the release surface 82 for opening the front jaw blocking member 80 and slide over the top of the second latching member 74 in the event of the further extension of the second latching member corresponding to that shown in FIG. 8 such that the flat underside of the release member 36 can engage with the reverse side 136 of that flange.

Figure 15:
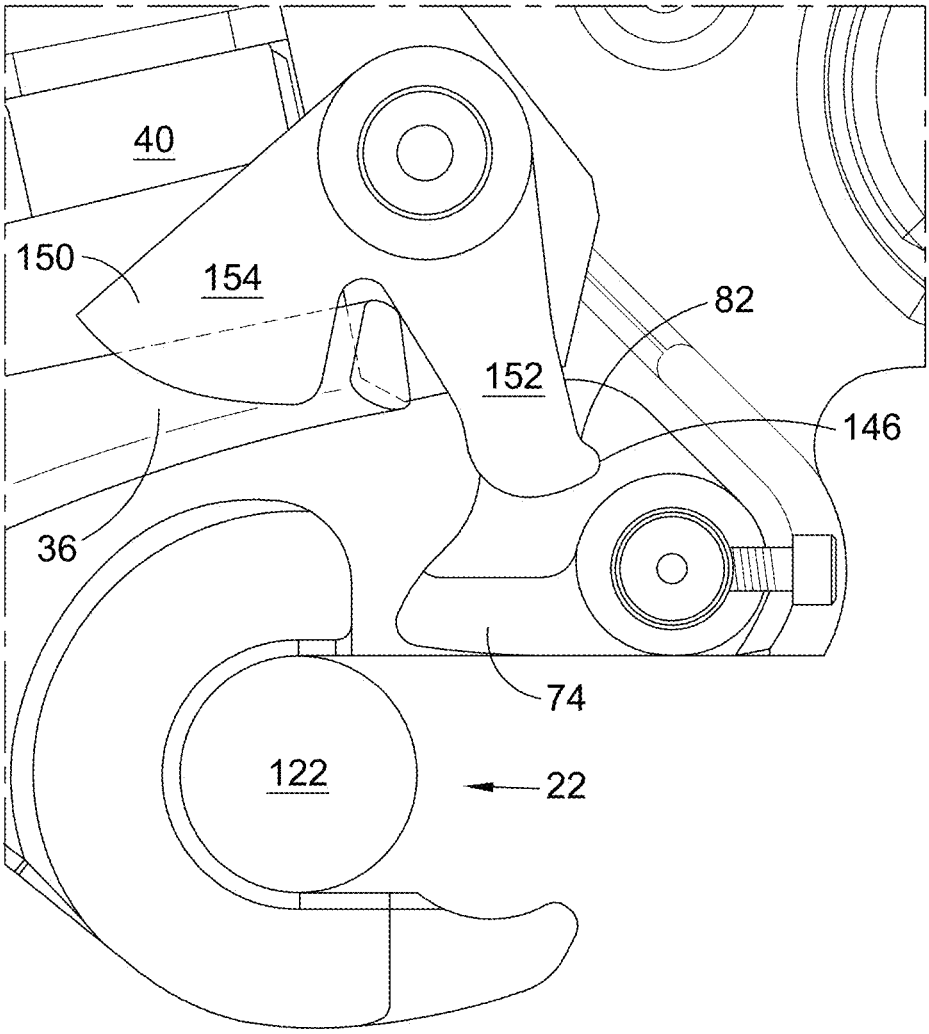
FIG. 15 shows an indirect mode of operation for the release member with respect to the second latching member.

Referring finally to FIG. 15, another variant is provided wherein the release member 36 engages indirectly with the second latching member 74 by way of a pivotal member 150. To release the first attachment pin 122 from the front jaw 22, the release member 36 is drawn forwards by the cylinder 40 as before, but now it engages against the pivotal member 150 to thus provide actuation of the second latching member 74 by the pivotal member 150 having an actuator finger 152 with a tip which engages the release surface 82 of the second latching member 74.

If instead this is an unsafe release, the second latching member 74 will be in an advance blocking condition whereby the finger 152 will pass over the top of the member comprising the release surface 82 which will either allow the finger 152 to instead block the second latching member 74 from being opened or will allow a second finger 154 to rotate around to block the rotation of the second latching member 74.

Preferably the range of movement of the second latching member is 30° from the default position, such that it rotates upwards into the open configuration and downwards into the advance blocking condition.

These and other features of the present invention have been described above purely by way of example. Modifications in detail may be made to the invention within the scope of the claims appended hereto.

The invention claimed is:

1. A coupler comprising a housing with a top part for attachment to an excavator arm of an excavator, and a bottom part for attachment to an accessory for the excavator, such as an excavator bucket, the bottom part comprising a front jaw open to a front of the coupler for receiving a first attachment pin of an accessory and a rear pin receiving area open to a bottom of the coupler for receiving a second attachment pin of the accessory, the coupler further comprising a first latching member, the first latching member being for the rear pin receiving area, the first latching member comprising a body, a further jaw extending below the body, a release member extending forward of the body and an attachment point for an end of an actuator, the coupler further comprising a second latching member, the second latching member being for the front jaw, the second latching member comprising a hub that is mounted for axial rotation about its axis, the hub having extending therefrom a front jaw blocking member and a release surface, the release surface angled away from the front jaw blocking member, the release surface being for engagement by, or indirectly by the release member extending from the body of the first latching member, wherein the rotation axis for the hub is located nearer the front of the coupler than the attachment pin seated position of the front jaw and the second latching member is spring biased into a front jaw blocking position in which the front jaw blocking member extends at least partially across an opening or mouth of the front jaw;

wherein either the hub is provided with a square section along at least a part of its length, which square section is mounted within a larger square tube or formation in a manner in which there is a variable relative angle of rotation therebetween, but with a default relative angle of rotation of about 45°, with elastically deformable members provided in four corners of the larger square to provide that default relative angle, the elastically deformable members bearing against outside faces of the square section of the hub and inside corners of the larger square, or the hub is provided with a hollow square form along at least a part of its length, which hollow square form is mounted around a smaller square axle pin, in a manner in which there is a variable relative angle of rotation therebetween, but with a default relative angle of rotation of about 45°, with elastically deformable members provided in the four corners of the larger square to provide that default relative angle, the elastically deformable members bearing against the outside faces of the square axle pin and the inside corners of the hollow square form.

2. The coupler of claim 1, wherein the front jaw blocking member and the release surface are formed, moulded or mounted onto the hub.

3. The coupler of claim 1, wherein the hub of the second latching member is pivotally mounted onto a frame by an axle pin.

4. The coupler of claim 1, wherein the large square tube or formation or the hollow square form is formed by an integral square section or by mounting a folded member forming three sides onto a flat surface, thus constructing a square form.

5. The coupler of claim 1, wherein the axis of the hub is a fixed axis relative to the coupler housing.

6. A coupler comprising a housing with a top part for attachment to an excavator arm of an excavator, and a bottom part for attachment to an accessory for the excavator, such as an excavator bucket, the bottom part comprising a front jaw open to a front of the coupler for receiving a first attachment pin of an accessory and a rear pin receiving area open to a bottom of the coupler for receiving a second attachment pin of the accessory, the coupler further comprising a first latching member for the rear pin receiving area, the first latching member comprising a body, a further jaw extending below the body and defining a mouth for accommodating the second attachment pin upon attachment of the accessory to the coupler, an attachment point for an end of an actuator and a hole through the body into which a sprung member is located, wherein the sprung member extends through and to under the body and into or partially across the mouth of the further jaw to hold or retain the second attachment pin of the accessory in the mouth of the further jaw so as to prevent release of that second attachment pin, when the second attachment pin is in that further jaw, in an event of a failure of the actuator, by preventing retraction of the first latching member out of the rear pin receiving area, the sprung member being biased by a biasing member to default the sprung member into its extended state through and to under the body and into or partially across a mouth of the further jaw and with a spring force large enough to carry working loads of the accessory, but low enough to be overridden by the actuator when driving the latching member into its open configuration, and wherein the further jaw comprises a top wall, a back wall and a bottom wall, wherein the mouth opposes the back wall, and wherein the bottom wall comprises a lip at its free end, wherein the lip defines an upwardly angled slope that resists an exit of the pin from a grasp of the further jaw, the coupler further comprising a second latching member, the second latching member being for the front jaw, the second latching member comprising a hub that is mounted for axial rotation about its axis, the hub having extending therefrom a front jaw blocking member and a release surface, the release surface angled away from the front jaw blocking member, the release surface being for engagement by, or indirectly by the release member extending from the body of the first latching member, wherein the rotation axis for the hub is located nearer the front of the coupler than the attachment pin seated position of the front jaw and the second latching member is spring biased into a front jaw blocking position in which the front jaw blocking member extends at least partially across the opening or mouth of the front jaw;

wherein either the hub is provided with a square section along at least a part of its length, which square section is mounted within a larger square tube or formation in a manner in which there is a variable relative angle of rotation therebetween, but with a default relative angle of rotation of about 45°, with elastically deformable members provided in four corners of the larger square to provide that default relative angle, the elastically deformable members bearing against outside faces of the square section of the hub and inside corners of the larger square, or the hub is provided with a hollow square form along at least a part of its length, which hollow square form is mounted around a smaller square axle pin, in a manner in which there is a variable relative angle of rotation therebetween, but with a default relative angle of rotation of about 45°, with elastically deformable members provided in the four corners of the larger square to provide that default relative angle, the elastically deformable members bearing against the outside faces of the square axle pin and the inside corners of the hollow square form.

7. The coupler of claim 6, wherein the rear pin receiving area is a rear jaw that is open to the bottom of the coupler.

8. The coupler of claim 6, wherein the attachment point is part of, or associated with, an actuator or hydraulic ram receiving formation into which a head and/or cylinder of the actuator or ram is accommodated.

9. The coupler of claim 6, wherein the upwardly angled slope of the further jaw leads from the back wall of the further jaw towards a free end of the further jaw at a free end of the bottom wall, and wherein the upwardly angled slope defines a back part of the bottom wall, and on which the second accessory pin will sit upon closure of the further jaw.

10. The coupler of claim 6, wherein the sprung member has an end face that is tapered, angled or rounded.

11. The coupler of claim 10, wherein the upwardly angled slope is combined with the lip to define a depression or a recess into which the second attachment pin of the accessory can rest in an event of a retraction of the further jaw, out of which the accessory pin would need to lift in order to clear the lip.

12. The coupler of claim 11, wherein the top wall of the further jaw is nearer the top part of the coupler than a top wall of the rear jaw and the free end of the sprung member extends below an upper wall of the rear pin receiving area when in its extended position.

13. The coupler of claim 6, wherein an upper wall of the rear pin receiving area is substantially planar, with the first latching member being a sliding latching member.

14. The coupler of claim 6, wherein the front jaw has a recess in its bottom surface with a lip at the free end thereof.

15. The coupler of claim 6, wherein the first latching member is a slidable latching member, with the body arranged to slide relative to the housing in a forward and rearward direction.

16. The coupler of claim 6, wherein an upper wall of the rear pin receiving area is convexly curved about a central part thereof, as viewed from a side of the coupler, with the latching member being a pivotal latching member, with a radial center of the convex curve falling at a hinge axis of the latching member.

17. The coupler of claim 6, wherein the spring force within the sprung member is between 50 and 400N.

18. The coupler of claim 6, wherein the spring force is one of the following:

i) between 50 and 100 Newtons for a coupler with working loads not exceeding 6,000 kg;

ii) between 80 and 200 Newtons for a coupler with working loads not exceeding 12,000 kg; or iii) between 150 and 300 Newtons for a coupler with working loads not exceeding 22,000 kg.

* * * * *